US005708931A

United States Patent [19]

Foley et al.

[11] Patent Number: 5,708,931

[45] Date of Patent: Jan. 13, 1998

[54] MAGNETIC IMAGING MEMBER

[75] Inventors: Geoffrey M. T. Foley, Fairport; William G. Herbert, Williamson; Mark C. Petropoulos, Ontario; Richard H. Nealey, Penfield; Robert A. Duffy, Webster, all of N.Y.

[73] Assignee: Xerox Corporation, Stamford, Conn.

[21] Appl. No.: 686,875

[22] Filed: Jul. 26, 1996

[51] Int. Cl.[6] ..... G03G 15/00

[52] U.S. Cl. ..... 399/159; 430/60; 430/63

[58] Field of Search ..... 399/159; 430/60, 430/63, 69

[56] References Cited

U.S. PATENT DOCUMENTS

| | | | |
|---|---|---|---|
| 3,684,368 | 8/1972 | Tanno | 399/159 X |
| 3,888,666 | 6/1975 | Matsumoto | 96/1 R |
| 4,369,242 | 1/1983 | Arimilli et al. | 430/58 |
| 4,376,813 | 3/1983 | Yuge et al. | 430/100 |
| 4,770,964 | 9/1988 | Fender | 430/65 |
| 4,865,936 | 9/1989 | Asanae et al. | 430/100 |
| 5,049,935 | 9/1991 | Saito | 399/168 |
| 5,105,222 | 4/1992 | Ohta et al. | 399/159 |
| 5,166,023 | 11/1992 | Harada et al. | 430/62 |

*Primary Examiner*—William J. Royer
*Attorney, Agent, or Firm*—Zosan S. Soong

[57] ABSTRACT

The enclosed an electrostatographic printing apparatus including: (a) an imaging member capable of retaining a latent image, wherein the imaging member includes an imaging layer on a substrate comprised of a magnetic material with a magnetic permeability of at least 1.001; (b) charging apparatus for charging the surface of the imaging member, thereby resulting in a charged surface; (c) exposure apparatus for exposing a portion of the charged surface to radiation, thereby substantially discharging the exposed portion, wherein the substantially discharged, exposed portion corresponds to the image area of the latent image; and (d) a single component development apparatus for depositing toner particles on the substantially discharged, exposed portion of the imaging member.

11 Claims, 1 Drawing Sheet

MAGNETIC IMAGING MEMBER

BACKGROUND OF THE INVENTION

This invention relates generally to a magnetic imaging member and more specifically to an electrostatographic printing apparatus, especially a xerographic printing apparatus, incorporating a magnetic imaging member which develops a latent image by reversal development. As is well known in reversal development (also referred to as negative development or discharge area development), the relative charges of the latent image and the developing particles are such that the quantity of developing particles attracted to the latent image bearing imaging member will vary inversely with the quantity of charge forming the latent image. In other words, the portion of the surface having maximum electric charge will have little or no developing particles attracted thereto, whereas the portion of the surface having a lesser charge will have correspondingly greater mounts of developing particles adhered thereto. Preferably, in reversal development, the developing particles are charged to the same polarity as the charged imaging member. Reversal development processes and apparatus are illustrated in Matsumoto, U.S. Pat. No. 3,888,666; Saito et al., U.S. Pat. No. 5,049,935; Asanae et al., U.S. Pat. No. 4,865,936; Harada et al., U.S. Pat. No. 5,166,023; and Yuge et al., U.S. Pat. No. 4,376,813, the disclosures of which are totally incorporated by reference. As used herein, the phrase printing apparatus or printing machine includes copiers and printers.

It is known to use in positive development (with magnetic toner in a two component development system) imaging members containing an inorganic photoconductive material over an electroformed nickel belt as the substrate in electrostatographic printing apparatus. As is well known, positive development (also referred to as charge area development) involves depositing developing particles on the unexposed areas of the latent image having relatively higher electric charge. Typically, in positive development, the developing particles are charged to the opposite polarity of the latent image.

The present inventors have discovered that employing a magnetic imaging member in reversal development provides a number of benefits. For example, the present invention improves the fine line density and the half tones, and provides darker solid areas, in prints produced from an electrostatographic printing apparatus. In addition, an imaging member having a magnetic substrate such as made from magnetic stainless steel improves the handling characteristics of the imaging member during its fabrication. For example, the magnetic substrate may be picked up, moved, or held down via magnetic forces. This represents an advantage in the design of simple low cost material handling equipment in a photoreceptor fabrication plant.

Tanno, U.S. Pat. No. 3,684,368, discloses in column 4, Experiment 1, a substrate fabricated from stainless steel. Regarding stainless steel, there is known stainless steel 304 which is considered paramagnetic since it has a magnetic permeability of less than 1.001. Paramagnetic stainless steel 304, however, is different from ferromagnetic stainless steel 304 having a magnetic permeability of greater than 1.001. Magnetic permeability refers to a material which extends the magnetic lines of flux versus ferromagnetic which is a material (for example, iron, nickel, cobalt) which is attracted to and/or held to a magnet. Ferromagnetic materials are also magnetically permeable.

Arimilli et al., U.S. Pat. No. 4,369,242, discloses in column 1, lines 37–38, a substrate fabricated from "a metal such as brass, aluminum, gold, platinum, steel."

Fender, U.S. Pat. No. 4,770,964, discloses a magnetic imaging member and a fabrication process therefor.

SUMMARY OF THE INVENTION

The present invention is directed in embodiments towards an electrostatographic printing apparatus comprising:

(a) an imaging member capable of retaining a latent image, wherein the imaging member includes an imaging layer on a substrate comprised of a magnetic material with a magnetic permeability of at least 1.001;

(b) charging apparatus for charging the surface of the imaging member, thereby resulting in a charged surface;

(c) exposure apparatus for exposing a portion of the charged surface to radiation, thereby substantially discharging the exposed portion, wherein the substantially discharged, exposed portion corresponds to the image area of the latent image; and (d) a single component development apparatus for depositing toner particles on the substantially discharged, exposed portion of the imaging member.

BRIEF DESCRIPTION OF THE DRAWINGS

Other aspects of the present invention will become apparent as the following description proceeds and upon reference to FIG. 1 showing a schematic elevational view of a preferred electrophotographic printing apparatus.

DETAILED DESCRIPTION

Figure 1:
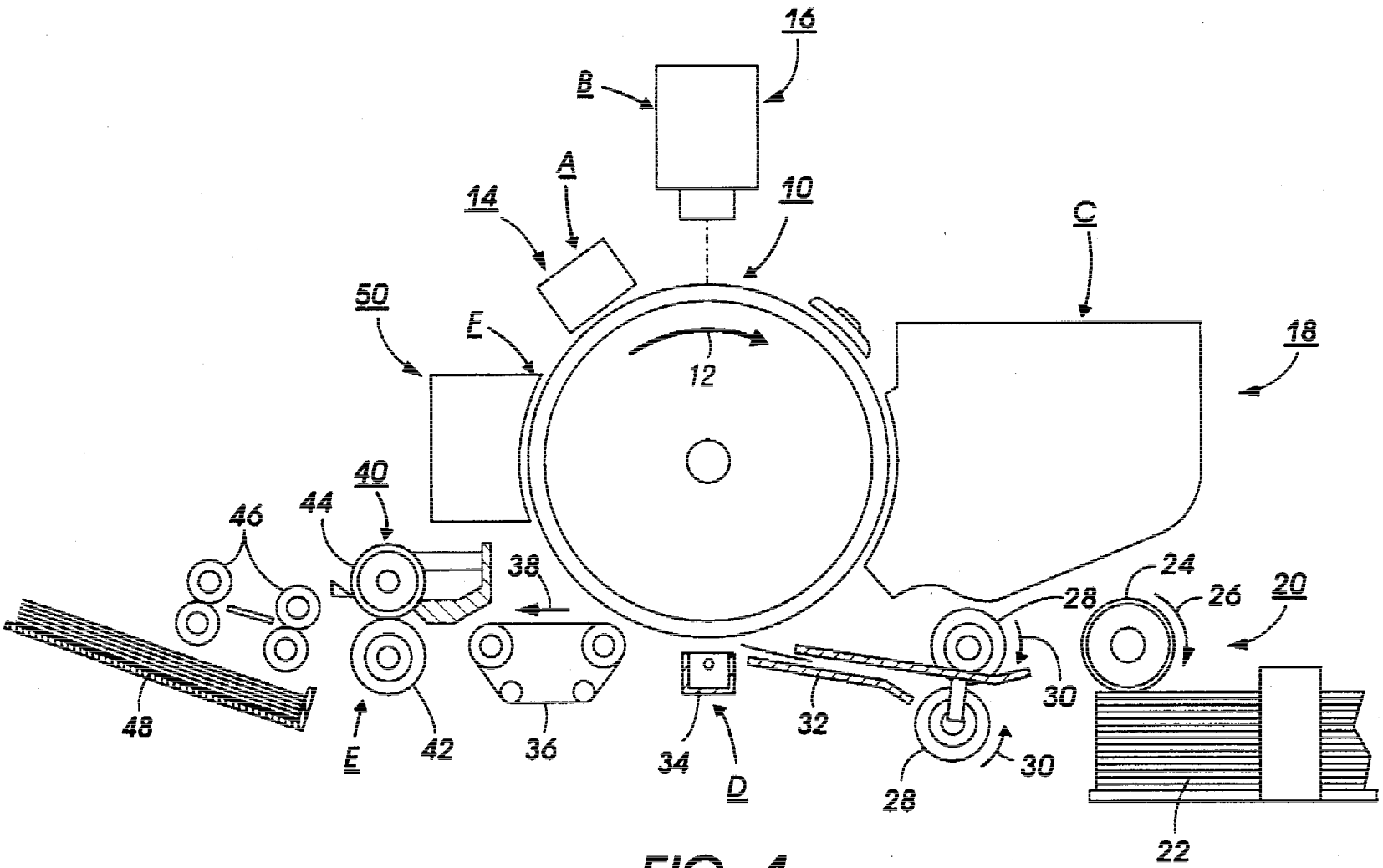

The electrostatographic imaging member is composed of at least one imaging layer on a substrate comprised of a ferromagnetic material. The substrate may have a wall thickness ranging for example from about 50 Angstroms to about 5 cm, preferably from about 1 mm to about 20 mm, and may be in the form of a hollow cylinder, a plate, or a flexible belt. The ferromagnetic material may have a magnetic permeability (also referred to herein as "mp") for instance of least 1.001, preferably at least about 1.008, more preferably from about 5 to about 1200, and most preferably from about 10 to about 1000. The ferromagnetic material preferably is ferromagnetic stainless steel including for example stainless steel 410 (mp 700–1000), stainless steel 416, stainless steel 420, stainless steel 434 (top 600–1100), stainless steel 440A, and ferromagnetic stainless steel 304. Other preferred ferromagnetic materials include nickel, iron, and cobalt. Other suitable magnetic materials for the substrate as well as a description of the general principles of magnetism are discussed in F. Brailsford, "Physical Principles of Magnetism" (1966); Richard M. Bozorth, "Ferromagnetism" (1978); and American Society For Metals, "Metals Handbook Ninth Edition, Vol. 3 Properties and Selection: Stainless Steels, Tool Materials and Special-Purpose Metals," pp. 597–611, the disclosures of which are totally incorporated herein by reference.

The imaging layer or layers may comprise for example a photoconductive material and a charge transport material in the same layer or different layers. Illustrative photoreceptors, charge generating materials, charge transport materials, and photoreceptor fabrication techniques are disclosed in for example in U.S. Pat. Nos. 4,265,990; 4,390,611; 4,551,404; 4,588,667; 4,596,754; 4,797,337; 4,965,155; and 5,004,662, the disclosures of which are totally incorporated by reference.

The photoconductive material is capable in embodiments of generating electronic charge carders in response to the absorption of radiation to be recorded by the imaging photoreceptor. The photoconductive material may be any suitable organic or inorganic photoconductor. Illustrative organic photoconductive charge generating materials include azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments; indigo pigments such as indigo, thioindigo, and the like; bisbenzoimidazole pigments such as Indofast Orange toner, and the like; phthalocyanine pigments such as copper phthalocyanine, aluminochlore-phthalocyanine, and the like; quinacridone pigments; or azulene compounds. Suitable inorganic photoconductive materials include for example cadium sulfide, cadmium sulfoselenide, cadmium selenide, crystalline and amorphous selenium, lead oxide and other chalcogenides. Alloys of selenium are encompassed by embodiments of the instant invention and include for instance selenium-arsenic, selenium-tellurium-arsenic, and selenium-tellurium.

Charge transport materials include an organic polymer or non-polymeric material capable of supporting the injection of photoexcited holes or transporting electrons from the photoconductive material and allowing the transport of these holes or electrons through the organic layer to selectively dissipate a surface charge. Illustrative charge transport materials include for example a positive hole transporting material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and hydrazone compounds. Typical hole transport materials include electron donor materials, such as carbazole; N-ethyl carbazole; N-isopropyl carbazole; N-phenyl carbazole; tetraphenylpyrene; 1-methyl pyrene; perylene; chrysene; anthracene; tetraphene; 2-phenyl naphthalene; azopyrene; 1-ethyl pyrene; acetyl pyrene; 2,3-benzochrysene; 2,4-benzopyrene; 1,4-bromopyrene; poly (N-vinylcarbazole); poly(vinylpyrene); poly(-vinyltetraphene); poly(vinyltetracene) and poly (vinylperylene). Suitable electron transport materials include electron acceptors such as 2,4,7-trrinitro-9-fluorenone; 2,4,5,7-tetranitro-fluorenone; dinitroanthracene; dinitroacridene; tetracyanopyrene and dinitroanthraquinone.

The imaging member may contain one or more additional layers conventionally employed in photoreceptors including for example an anticurl layer, an adhesive layer, a blocking layer, and the like.

FIG. 1 schematically depicts the various components of an illustrative electrophotographic printing machine. It will become evident from the discussion herein that the magnetic imaging member of the instant invention is equally well suited for use in a wide variety of electrostatographic printing machines and is not necessarily limited in its application to the particular embodiment shown herein. Inasmuch as the art of electrophotographic printing is well known, the various processing stations employed in the FIG. 1 printing machine will be shown hereinafter schematically and their operation described briefly with reference thereto.

As shown in FIG. 1, the printing machine employs a ferromagnetic imaging member 10 which may be in the form of a drum. As explained in more detail herein, imaging member 10 is composed of at least one imaging layer including a photoconductive material on a ferromagnetic substrate. Imaging member 10 rotates in the direction of arrow 12 to pass through the various processing stations disposed thereabout.

Initially, imaging member 10 moves a portion of the photoconductive surface through charging station A. At charging station A, a corona generating device, indicated generally by the reference numeral 14, charges the photoconductive surface of imaging member 10 to a relatively high, substantially uniform potential such as for example from about −700 V to about −200 V. The corona generating device may be for instance a corotron, scorotron, dicorotron, picorotron, or charge roller.

Thereafter, the charged portion of the photoconductive surface of imaging member 10 is advanced through exposure station B. At exposure station B, an original document is positioned face down upon a transparent platen. The exposure system, indicated generally by the reference numberal 16, includes a lamp which moves across the original document illuminating incremental widths thereof. The light rays reflected from the original document are transmitted through a moving lens to form incremental width light images. These light images are focused onto the charged portion of the photoconductive surface. In this manner, the charged photoconductive surface of imaging member 10 is discharged selectively by the light image of the original document. This records an electrostatic latent image on the photoconductive surface of imaging member 10 which corresponds to the informational areas contained within the original document.

In alternative embodiments, exposure station B may include a raster output scanner which lays out the electrostatic latent image in a series of horizontal scan lines with each line having a specified number of pixels per inch. The raster output scanner may employ a laser which generates a beam of light rays that are modulated by rotating polygon mirror blocks or solid state image modulator bars. Alternatively, the raster output scanner may use light emitting diode array write bars.

Next, imaging member 10 advances the electrostatic latent image recorded on the photoconductive surface to development station C. At development station C, a magnetic brush development system, indicated generally by the reference numeral 18, advances the developing particles into contact with the electrostatic latent image recorded on the photoconductive surface of imaging member 10. The latent image attracts the developing particles thereto forming a particle image on the photoconductive surface of imaging member 10. At the time of latent image development, a bias voltage may be applied between the imaging member 10 and the development system 18. The bias voltage may be a DC voltage or an AC voltage superposed with a DC voltage. Particularly in reversal development, the bias voltage should be equal to or lower than the potential at the unexposed portion of the imaging member. After the particle image is formed on the photoconductive surface, imaging member 10 advances the particle image to transfer station D.

At transfer station D, a sheet of support material is positioned in contact with the particle image formed on the photoconductive surface of imaging member 10. The sheet of support material is advanced to the transfer station by a sheet feeding apparatus, indicated generally by the reference numeral 20. Preferably, sheet feeding apparatus 20 includes a feed roll 24, contacting the uppermost sheet of the stack 22 of sheets of support material. Feed roll 24 rotates in the direction of arrow 26 so as to advance the uppermost sheet from stack 22. Registration rollers 28, rotating in the direction of arrows 30, align and forward the advancing sheet of support material into chute 32. Chute 32 directs the advancing sheet of support material into contact with the photoconductive surface of imaging member 10 in a timed sequence. This insures that the particle image contacts the advancing sheet of support material at transfer station D.

Transfer station D includes a corona generating device 34 which applies a spray of ions to the backside of the sheet. This attracts the particle image from the photoconductive surface of imaging member 10 to the sheet. After transfer, the sheet continues to move with imaging member 10 and is separated therefrom by a detack corona generating device (not shown) which neutralizes the charge causing the sheet to adhere to the imaging member. Conveyor 36 advances the sheet, in the direction of arrow 38, from transfer station D to fusing station E.

Fusing station E, indicated generally by the reference numeral 40, includes a back-up roller 42 and a heated fuser roller 44. The sheet of support material with the particle image thereon passes between back-up roller 42 and fuser roller 44. The particles contact fuser roller 44 and the heat and pressure applied thereto permanently affix them to the sheet of support material. After fusing, forwarding rollers 46 advance the finished copy sheet to catch tray 48. Once the copy sheet is positioned in catch tray 48, it may be removed therefrom by the machine operator.

Invariably, after the sheet of support material is separated from the photoconductive surface of imaging member 10, some residual particles remain adhering thereto. These residual particles are cleaned from imaging member 10 at cleaning station F. Preferably, cleaning station F includes a cleaning mechanism 50 which comprises a pre-clean corona generating device and a rotatable fiberous brush in contact with the photoconductive surface of imaging member 10. The pre-clean corona generator neutralizes the charge attracting the particles to the photoconductive surface. The particles are then cleaned from the photoconductive surface by the rotation of the brush in contact therewith. Subsequent to cleaning, a discharge lamp floods the photoconductive surface with light to dissipate any residual electrostatic charge remaining thereon prior to the charging thereof for the next successive imaging cycle.

In preferred embodiments, the electrostatographic printing apparatus illustrated in FIG. 1 employs reversal development. Accordingly, with reference to FIG. 1, the exposure station B will expose a portion of the charged surface of the imaging member 10 to radiation, thereby substantially discharging or completely discharging the exposed portion, wherein the substantially discharged, exposed portion corresponds to the image area of the latent image; and development station C deposits developing particles on the substantially discharged, exposed portion of the imaging member.

The latent image may be developed by any suitable technique including for example magnetic brush development, powder cloud development, cascade development, and the like.

The development technique preferably uses single component developing particles (i.e., toner particles) rather than two component developing particles (i.e., toner and carrier particles). The toner particles preferably are magnetic. Magnetic toners may include alloys and compounds such as ferrite and magnetite composed of ferromagnetic elements such as iron, cobalt, and nickel. The amount of the magnetic powder contained in the toner is preferably from about 30 to about 70 weight percent based on the total weight of the toner. The toner particles also include resin binders which may be thermoplastic resins like monomers or copolymers of styrenes, vinyl esters, acrylonitrile, and acrylamide. Magnetic toners are described in Asanae et at., U.S. Pat. No. 4,865,936, the disclosure of which is hereby totally incorporated by reference.

The present invention improves print performance because more toner will be attracted to and held by a single pixel exposure point due to the magnetic properties of the photoreceptor substrate. In embodiments, the present invention using single component magnetic brush development, especially with magnetic toner particles, produces better fine line quality in the resulting prints than two component magnetic brush development. It is believed that in two component magnetic brush development, the magnetic brush is further away from the substrate, so that there is less interaction of the magnetic flux with the substrate. In summary, in the present invention, the magnetic substrate having a magnetic permeability of at least 1.001 gives a magnetic assist to the transfer of toner, thereby improving the resulting print quality.

Other modifications of the present invention may occur to those skilled in the art based upon a reading of the present disclosure and these modifications are intended to be included within the scope of the present invention.

We claim:

1. An electrostatographic printing apparatus comprising:

(a) an imaging member capable of retaining a latent image, wherein the imaging member includes an imaging layer on a substrate comprised of a magnetic material with a magnetic permeability of at least 1.001;

(b) charging apparatus for charging the surface of the imaging member, thereby resulting in a charged surface;

(c) exposure apparatus for exposing a portion of the charged surface to radiation, thereby substantially discharging the exposed portion, wherein the substantially discharged, exposed portion corresponds to an image area of the latent image; and (d) a single component development apparatus for depositing toner particles on the substantially discharged, exposed portion of the imaging member.

2. The apparatus of claim 1, wherein the magnetic material is ferromagnetic stainless steel.

3. The apparatus of claim 1, wherein the magnetic material is selected from the group consisting of stainless steel 410, stainless steel 416, stainless steel 420, stainless steel 434, stainless steel 440A, and ferromagnetic stainless steel 304.

4. The apparatus of claim 1, wherein the magnetic material is nickel.

5. The apparatus of claim 1, wherein the magnetic material is selected from the group consisting of iron and cobalt.

6. The apparatus of claim 1, wherein the magnetic material has a magnetic permeability of at least about 1.008.

7. The apparatus of claim 1, wherein the magnetic material has a magnetic permeability ranging from about 5 to about 1200.

8. The apparatus of claim 1, wherein the magnetic material has a magnetic permeability ranging from about 10 to about 1000.

9. The apparatus of claim 1, wherein the imaging layer includes an organic photoconductive material.

10. The apparatus of claim 1, wherein the toner particles are magnetic.

11. The apparatus of claim 1, wherein the toner particles are charged to the same polarity as the charged surface.

* * * * *